US011434046B2

(12) United States Patent
Fernandes

(10) Patent No.: US 11,434,046 B2
(45) Date of Patent: Sep. 6, 2022

(54) CONSTRUCTIVE ARRANGEMENT FOR THE OPENING OF A BEVERAGE CAN

(71) Applicant: João Marques Fernandes, Belo Horizonte-MG (BR)

(72) Inventor: João Marques Fernandes, Belo Horizonte-MG (BR)

( * ) Notice: Subject to any disclaimer, the term of this patent is extended or adjusted under 35 U.S.C. 154(b) by 277 days.

(21) Appl. No.: 16/464,168

(22) PCT Filed: Nov. 22, 2017

(86) PCT No.: PCT/BR2017/050354

§ 371 (c)(1),
(2) Date: May 24, 2019

(87) PCT Pub. No.: WO2018/094492

PCT Pub. Date: May 31, 2018

(65) Prior Publication Data

US 2020/0317396 A1 Oct. 8, 2020

(30) Foreign Application Priority Data

Nov. 25, 2016 (BR) ..... 202016027747.2
Feb. 17, 2017 (BR) ..... 202017003226.0

(51) Int. Cl.
*B65D 17/28* (2006.01)
*B65D 85/72* (2006.01)
*B65D 17/00* (2006.01)

(52) U.S. Cl.
CPC ..... *B65D 17/4012* (2018.01); *B65D 85/72* (2013.01); *B65D 17/02* (2013.01);
(Continued)

(58) Field of Classification Search
CPC ..... B65D 17/4012; B65D 51/1677; B65D 2517/0094
See application file for complete search history.

(56) References Cited

U.S. PATENT DOCUMENTS 3,221,924 A 12/1965 Harvey et al.
3,301,434 A 1/1967 Harvey et al.
(Continued)

FOREIGN PATENT DOCUMENTS

BR PI0403324 A 3/2006
BR 202014032067 U2 7/2015
(Continued)

OTHER PUBLICATIONS

International Search Report for International Application No. PCT/BR2017/050354 dated Jan. 23, 2018.
(Continued)

*Primary Examiner* — Jeffrey R Allen
(74) *Attorney, Agent, or Firm* — Dinsmore & Shohl LLP

(57) ABSTRACT

An apparatus is disclosed and includes a can, which has an end wall incorporating a vent panel and a pouring panel, both panels being breakable and presenting a contour defined by a rupture line. A first actuation tab is externally affixed to the vent panel and manually and angularly displaceable, in order to be separated from the can jointly with the vent panel. A second actuation tab, which may be actuated after the vent panel is removed, is externally affixed to the pouring panel and provided with an end lower tooth, which is pressed against the rupture line of the pouring panel, when the second actuation tab is displaced so as to break, initially, the confronting spot region of the rupture line and, subsequently, to separate the pouring panel from said end wall.

20 Claims, 6 Drawing Sheets

(52) U.S. Cl.
CPC ..... *B65D 2517/0013* (2013.01); *B65D 2517/0014* (2013.01); *B65D 2517/0016* (2013.01); *B65D 2517/0049* (2013.01); *B65D 2517/0062* (2013.01); *B65D 2517/0094* (2013.01)

(56) References Cited

U.S. PATENT DOCUMENTS

| | | | | |
|---|---|---|---|---|
| 3,477,608 | A | 11/1969 | Fraze | |
| 3,618,815 | A | 11/1971 | Heffner | |
| 3,655,091 | A | 4/1972 | La Croce | |
| 4,042,144 | A | 8/1977 | Henning et al. | |
| 4,094,435 | A | 6/1978 | Kennedy | |
| 4,872,597 | A | 10/1989 | Hanafusa | |
| 4,913,305 | A | 4/1990 | Hanafusa et al. | |
| 5,397,014 | A | 3/1995 | Aydt | |
| 5,411,159 | A | 5/1995 | Fan | |
| 5,695,085 | A | 12/1997 | Hadener | |
| 5,819,973 | A * | 10/1998 | Traub, Sr. ..... | B65D 17/4012 220/271 |
| 6,062,414 | A | 5/2000 | Mongarli et al. | |
| 2003/0098306 | A1 | 5/2003 | Cho | |
| 2010/0219188 | A1 | 9/2010 | Chang | |
| 2010/0258562 | A1 | 10/2010 | Linden et al. | |
| 2013/0264343 | A1 | 10/2013 | Neiner | |
| 2014/0263320 | A1 | 9/2014 | Forrest et al. | |
| 2014/0374419 | A1 * | 12/2014 | Neiner ..... | B65D 17/4012 220/271 |
| 2017/0057692 | A1 | 3/2017 | Fernandes | |
| 2017/0341808 | A1 | 11/2017 | Da Silva | |

FOREIGN PATENT DOCUMENTS

| | | | |
|---|---|---|---|
| BR | 202016006035 | U2 | 9/2017 |
| GB | 353598 | A | 7/1931 |

OTHER PUBLICATIONS

Brazilian Patent Application No. BR2020160009150 filed Jan. 15, 2016.

* cited by examiner

CONSTRUCTIVE ARRANGEMENT FOR THE OPENING OF A BEVERAGE CAN

CROSS-REFERENCE TO RELATED APPLICATIONS

This application is a U.S. national stage application of International Application No. PCT/BR2017/050354, filed on Nov. 22, 2017, which claims the benefit and priority of Brazilian Patent Application No. BR 20 2017003226-0, filed on Feb. 17, 2017, and Brazilian Patent Application No. BR 20 2016027747-2, filed on Nov. 25, 2016, the entire contents of each of the above applications are incorporated herein by reference.

TECHNICAL FIELD

The present disclosure relates to a new constructive arrangement applied to a beverage can, for allowing a quick and easy opening of the latter, by the provision of a vent opening and, optionally, of a pouring opening, in an end wall of the can, usually the upper wall or lid, when a user/consumer manually actuates a first, and if desired, a second actuation tab, allowing said two actuation tabs, jointly with the vent and pouring panels, which form the vent and the pouring openings, respectively, to be easily and quickly detached from the upper end wall of the can, immediately after liberation of each of said openings.

BACKGROUND

It is well known in the state of the art the use of cans having an end wall provided with a first and with a second tearable panels, in order to form, respectively, a vent opening and a pouring opening, the vent opening being diametrically spaced from the pouring opening, so as to assume an upper position in relation to the latter, when the can is inclined to a horizontal position, in order to allow the air to be continuously admitted into the can through the vent opening, while the beverage is being poured out from the can through the pouring opening. The provision of the vent opening allows the beverage to be released from the can, in a uniform flow and more rapidly.

Patent documents BR 20 2016 000915-0, BR 20 2016 006035-0, and US 2014/0263320 A1 illustrate the type of construction mentioned above, according to which the actuation of the user/consumer over a single actuation tab, promotes, initially, the rupture of the first panel (vent panel), with the formation of the vent opening for facilitating the discharge of the beverage through the pouring opening, which is subsequently formed upon rupture of the second panel, by the progressive action of the user/consumer over the single actuation tab.

In said known beverage cans, having two breakable panels, the actuation of the single actuation tab leads to the compulsory formation, not only of the vent opening, by removing the vent panel, but also, and subsequently, of the pouring opening, by pressing the second breakable panel, or pouring panel, to the interior of the can. The pouring panel is bent around a reduced and not weakened extension of its breakable contour, which extension operates as a hinge defined by the metal foil itself of the respective end wall of the can. In this known construction, the pouring panel remains attached to the end wall of the can, projecting to the interior of the latter, remaining in contact with the beverage and transmitting, to the latter, for ingestion of the user/consumer, all the pathogenic microorganisms usually present in the exterior of the end wall or lid of said cans, when the latter are not submitted to a rare efficient cleaning before being opened and, mainly, before being used as a "drinking glass". Besides maintaining the pouring panel attached to the can and projecting to the interior of the latter, this solution with a single tab prevents the user/consumer from promoting only the rupture of the vent panel, in order to form only the vent opening to be used to introduce the straw for consuming the beverage.

On the other hand, the solution of patent PI 0403324-8 provides two actuation tabs, which requires the user/consumer to pull one actuation tab, in order to form the vent opening and allow access to the other actuation tab, to be optionally pulled to form the pouring opening. Although allowing only the formation of the vent opening for introducing a straw to consume the beverage, said prior solution does not eliminate the inconvenience of maintaining the pouring panel projecting to the interior of the can upon formation of the pouring opening.

Patent documents GB 353,598, U.S. Pat. Nos. 3,655,091, 4,042,144, 4,913,305, and BR 20 2014 032067-4 describe different constructions for providing the opening of a pouring panel in an end wall of a can, by means of a single lever or tab which, when actuated by the user/consumer, promotes, initially, a rupture localized in the weakened line of the breakable contour of the pouring panel, allowing the tab or lever to be then pulled by the user/consumer, completing the rupture of the whole contour of the pouring panel, which is then detached from the can, without the inconvenience of being pressed to the interior of the latter and contacting the stored beverage.

While eliminating the problem of bending the pouring panel to the interior of the can, the constructive solutions mentioned in the previous paragraph do not allow the user/consumer to provide a vent opening for allowing the beverage to be released from the can in a uniform flow and more rapidly.

Patent document U.S. Pat. No. 3,477,608 discloses a constructive solution to provide the formation of a vent opening and, subsequently, the formation of a pouring opening in an end wall of a can, by means of a single lever or tab which, when actuated by the user/consumer, promotes, initially, the complete rupture of a vent panel and a localized rupture in the weakened line of the breakable contour of the pouring panel, allowing the single lever to be then pulled by the user/consumer, completing the rupture of the whole contour of the pouring panel, which is then detached from the can, without the inconvenience of being pressed to the interior of the latter and contacting the stored beverage.

Although eliminating the problem of bending the pouring panel to the interior of the can and of providing both the pouring opening and the vent opening, the construction described in document U.S. Pat. No. 3,447,608 does not allow the user/consumer to promote only one vent opening, if so desired, in order to consume the beverage by a usual straw, without the risks of causing splits which occur upon formation of the pouring opening, which presents a larger dimension. In these solutions, the single tab or lever promotes the compulsory formation of both openings.

SUMMARY

Due to the drawbacks mentioned above and related to the known solutions, it is an object of the present disclosure to provide a constructive arrangement for the opening of a beverage can, which allows the user/consumer to provide the formation of a vent opening and, subsequently, and if desired, the formation of a pouring opening spaced from the vent opening, both formed by the respective panels of the end wall of the can, which panels form the vent opening and the pouring opening and which are completely detached outwardly from the can.

The present constructive arrangement is applied to a beverage can of the type which comprises an end wall, in which are defined a vent panel and, spaced from the latter, a pouring panel with a larger contour.

According to the present disclosure, both panels have the contour thereof totally defined by a rupture line, it being also provided a first actuation tab, having an extracting end portion, externally affixed to the vent panel, and a grip end portion, which is manually and angularly displaced away from the end wall of the can and separated from the latter jointly with the vent panel, and a second actuation tab, which is optionally actuated after the vent panel is removed and presents a punching end portion, externally affixed to the pouring panel and provided with a lower end tooth, to be pressed against a confronting spot region of the rupture line which defines the contour of the pouring panel, and a grip end portion, whose manual angular displacement, away from the end wall of the can, breaks, initially, said spot region of the rupture line and, subsequently, separates the pouring panel from said end wall.

BRIEF DESCRIPTION OF THE DRAWINGS

The present disclosure will be described below, making reference to the attached drawings, given by way of example of a possible embodiment for the present constructive arrangement and in which.

DETAILED DESCRIPTION

Figure 1:
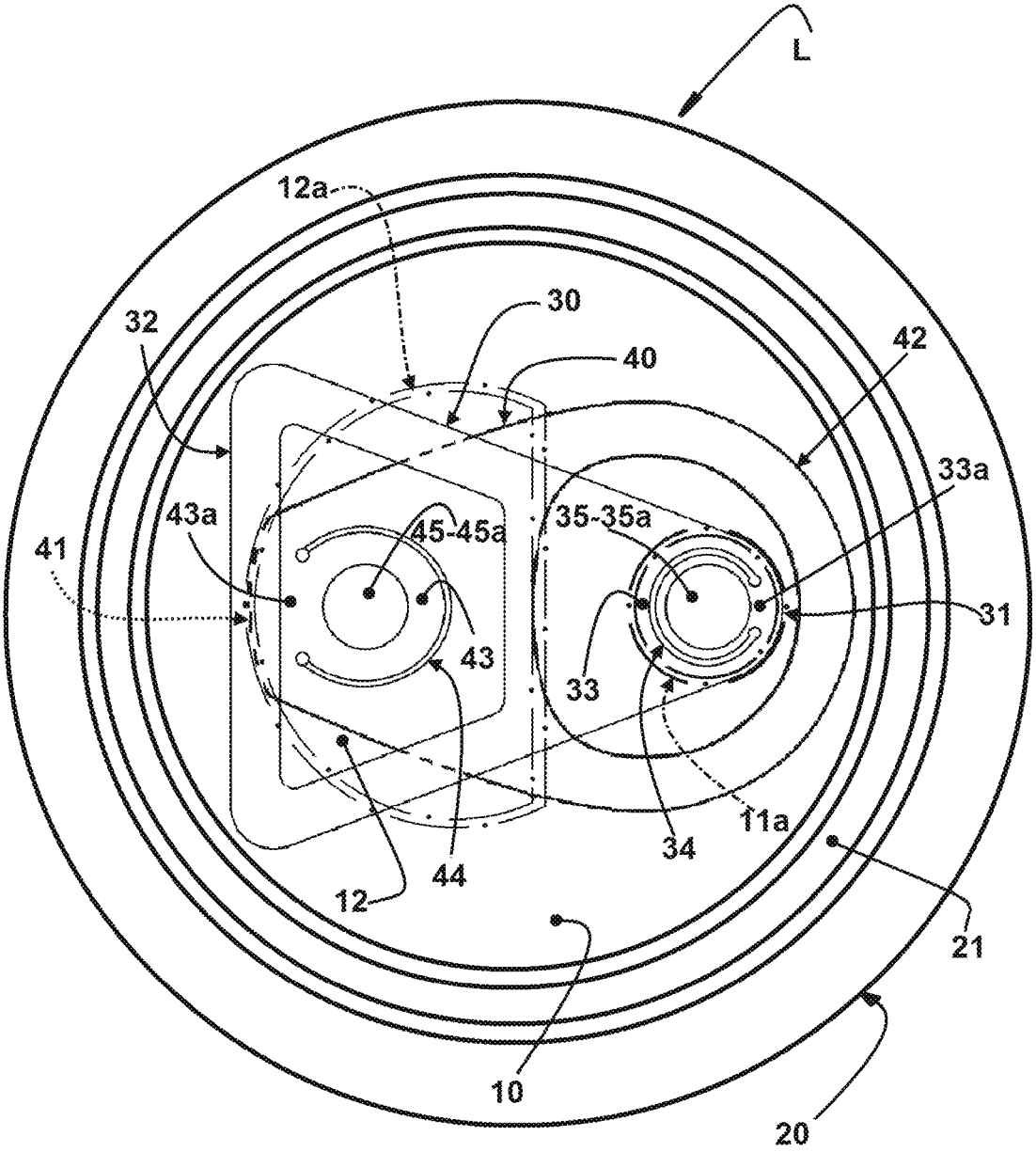
FIG. 1 represents an upper plan view of a beverage can of the type considered herein, in the closed condition and provided with the first and the second actuation tabs.

As illustrated in the appended drawings and discussed above, the present constructive arrangement is applied to a beverage can L of the type which comprises an end wall 10, usually in the form of an upper lid surrounded by an adjacent edge 21 defined in one of the ends of a usually cylindrical sidewall 20 of the can L. The end wall 10 incorporates a vent panel 11 and a pouring panel 12, which are spaced apart, generally in a diametrically opposite arrangement. It should be noted that the contour of the pouring panel 12 is generally much larger than that of the vent panel 11.

Figure 4:
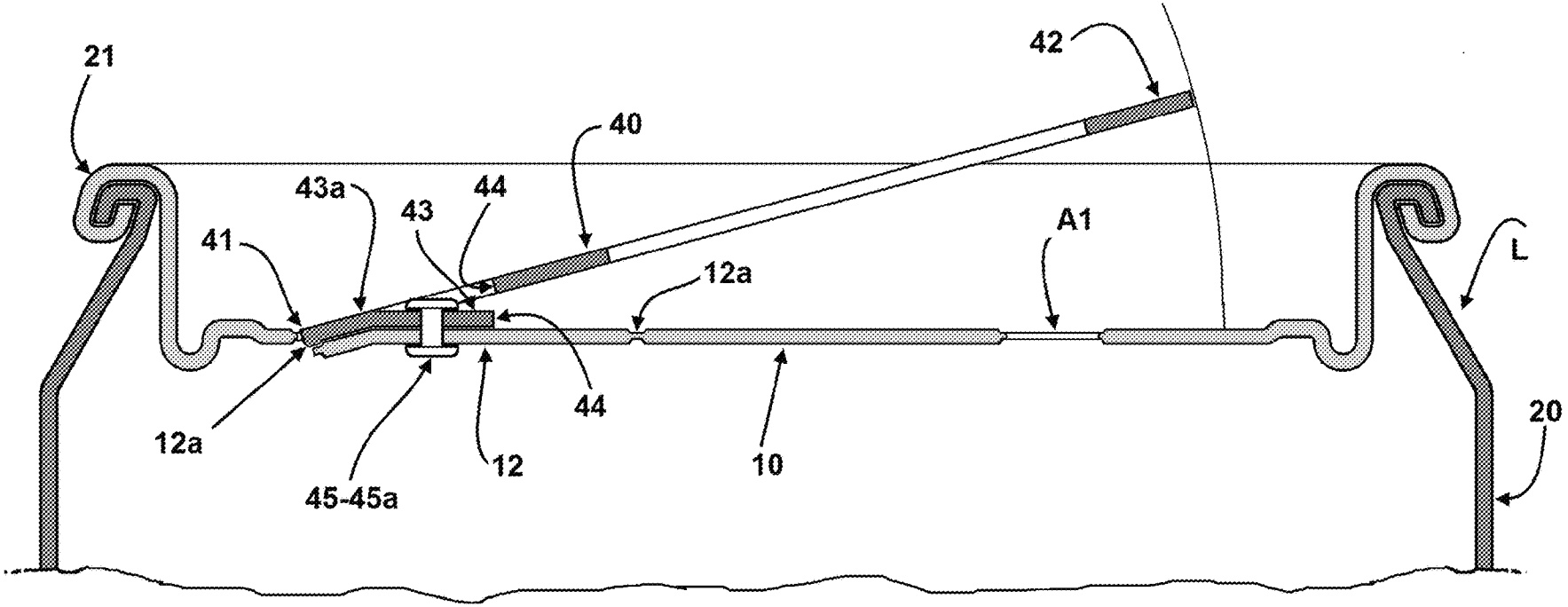
FIG. 4 represents an enlarged diametric sectional view of the upper portion of the can of FIG. 1, with the first actuation tab and with the associated vent panel already detached from the can and discarded, and with the grip portion of the second actuation tab already submitted to an initial ascending angular displacement, causing the rupture of the respective rupture line, in its region confronting with the end lower tooth of the second actuation tab.
Figure 5:
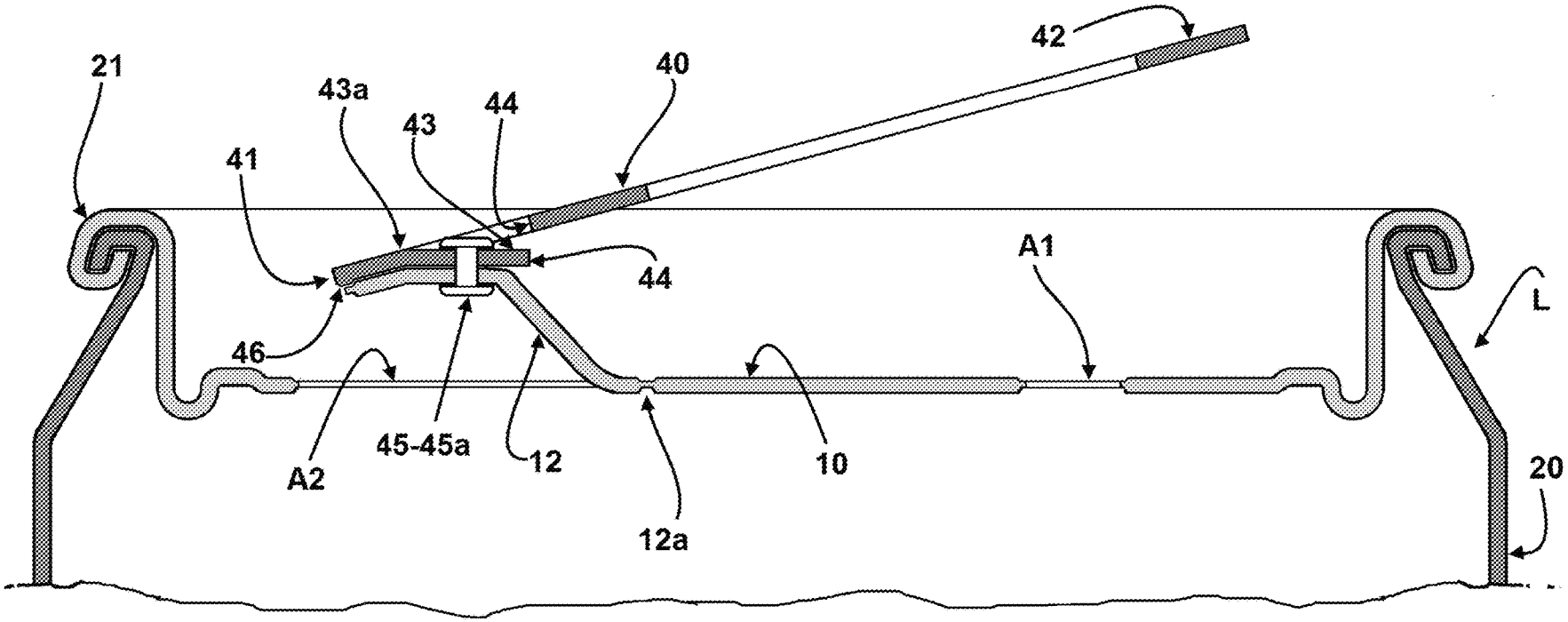
FIG. 5 represents the diametric sectional view illustrated in FIG. 4, but with the grip portion of the second actuation tab already markedly displaced away from the end wall of the can, initiating the rupture of the remaining part of the rupture line and the consequent separation of the pouring panel in relation to the can, in order to form the pouring opening.
Figure 6:
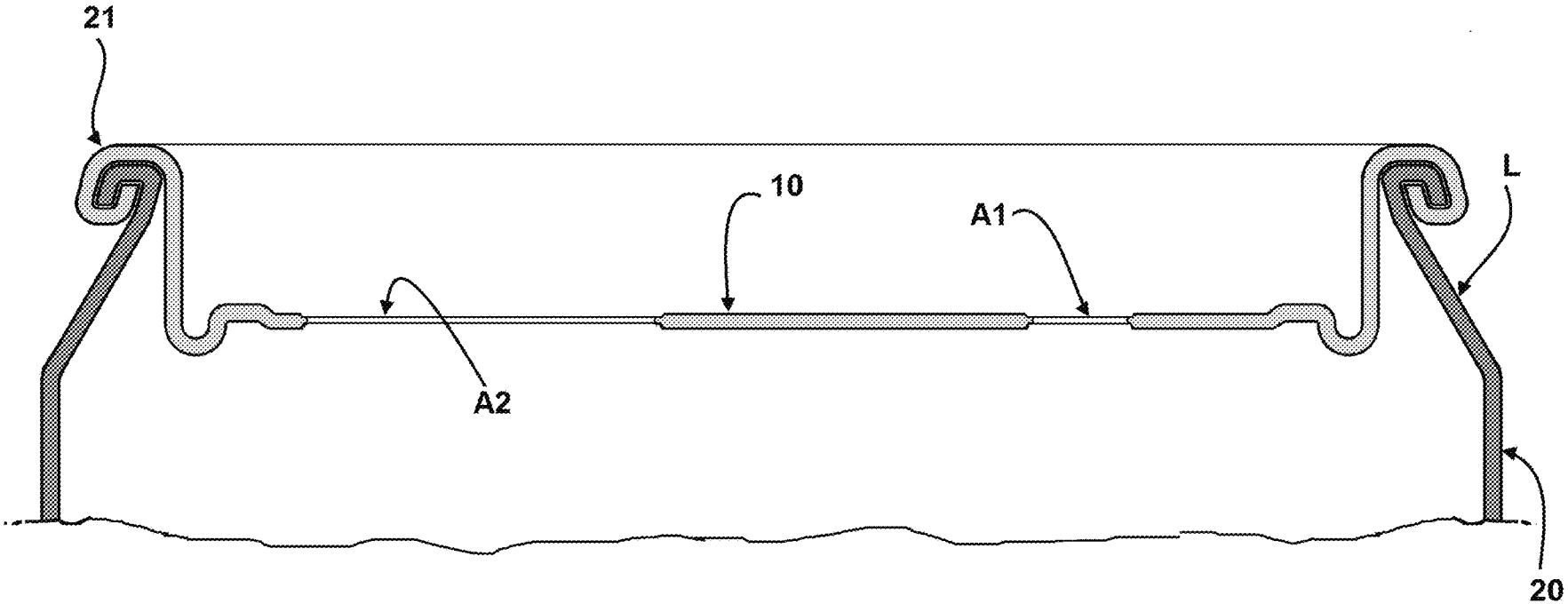
FIG. 6 represents the diametric sectional view illustrated in FIG. 5, but with the two actuation tabs and with the two panels totally detached from the can and discarded, for the formation of the vent and pouring openings.

According to a first aspect of the present disclosure, the vent panel 11 and the pouring panel 12 have the contours thereof totally defined by respective rupture lines 11*a*, 12*a*, which allow said respective panels to be ruptured along the contours thereof, for the formation of a vent opening A1 (as illustrated in FIGS. 4, 5, and 6) and, subsequently and optionally, of a pouring opening A2, respectively (as better illustrated in FIGS. 5 and 6). This type of can may be constructed in different ways well known in the art and which are not part of the present disclosure.

The can L further comprises a first actuation tab 30, constructed in a single piece and in any metal alloy adequate to the present use, having an extracting end portion 31, affixed externally to the vent panel 11 by a retention element 35, of any known construction and which, for example, may take the form of a rivet 35*a*, hermetically incorporated to the vent panel 11 of the end wall 10. The first actuation tab 30 further comprises a grip end portion 32, generally of annular shape and to be manually and angularly displaced away from the end wall 10 of the can L, breaking the rupture line 11*a* of the vent panel 11 and separating the latter from the end wall 10 of the can L, as illustrated in FIG. 4.

The extracting end portion 31 of the first actuation tab 30 may incorporate, in a single piece and through a hinge region 33*a*, a tab portion 33 which is cut out from the first actuation tab 30 by a cutout 34 in the form of a rounded "C", open to the hinge region 33*a* and allowing said tab portion 33 to define the portion of the first actuation tab 30 affixed to the retention element 35, externally to the vent panel 11.

The extracting end portion 31 of the first actuation tab 30 may further incorporate an end lower tooth 36, positioned over the rupture line 11*a* of the vent panel 11, in a region external to the cutout 34 and to the hinge region 33*a* of the tab portion 33, in order to be pressed against the confronting spot region 11*b* of said rupture line 11*a*, breaking the latter in said spot region 11*b* and allowing the ascending angular displacement of the grip end portion 32 of the first actuation tab 30 to be effected around the hinge region 33*a*, until occurring the initial rupture of the vent panel 11 and, with the progressive ascending angular displacement of the first actuation tab 30, obtaining the complete rupture of the rupture line 11*a* and the consequent complete separation of the vent panel 11 and of the first actuation tab 30 in relation to the can L.

The manual and angular displacement of the first actuation tab 30, initially around the hinge region 33*a* of the tab portion 33, causes the initial and eventually localized rupture of the rupture line 11*a*, when the end lower tooth 36 is provided. the progressive manual, angular and ascending displacement of the actuation tab 30 causes the complete rupture of the rupture line 11*a* of the vent panel 11, which is then integrally detached from the can L, jointly with the retention element 35, forming the vent opening A1 (see FIGS. 4, 5 and 6) which may be dimensioned so as to be able to receive a straw, when the user wishes to consume the beverage in this way, reducing the risk of spilling.

The present constructive arrangement further comprises a second actuation tab 40, having a punching end portion 41 affixed externally to the pouring panel 12 by a retention element 45, of any known construction known and which, for example, may take the form of rivet 45*a*, hermetically incorporated to the pouring panel 12 of the end wall 10, and a grip end portion 42, of annular shape, which may be manually and angularly displaced away from the wall 10 of the can L, after the first actuation tab 30 is removed, in order to break the rupture line 12*a* of the pouring panel 12 and separate totally the latter from the end wall 10 of the can L, forming the pouring opening A2 (see FIGS. 5 and 6). This construction allows the axial projection of the rupture line 11*a* of the vent panel 11 to be contained in the interior of the annular shape of the grip end portion 42 of the second actuation tab 40.

The punching end portion 41 of the second actuation tab 40 incorporates, in a single piece and through a hinge region 43*a*, a tab portion 43 which is cut out from the second actuation tab 40 by a cutout 44 in the form of a rounded "C", open to the hinge region 43*a* and which allows said tab portion 43 to define the portion of the second actuation tab 40 that is affixed to the retention element 45, externally to the pouring panel 12.

The punching end portion 41 of the second actuation tab 40 further incorporates an end lower tooth 46, positioned over the rupture line 12*a* of the pouring panel 12, so as to be pressed against a confronting spot region 12*b* of the rupture line 12*a*, external to the cutout 44 and to the hinge region 43*a* of the tab portion 43, breaking the latter in said spot region 12*b* and allowing the ascending angular displacement of the grip end portion 42 of the second actuation tab 40 to be effected around the hinge region 43*a*, until occurring the initial rupture of the pouring panel 12 and, with the progressive ascending angular displacement of the second actuation tab 40, obtaining the complete rupture of the rupture line 12*a* and the consequent complete separation of the pouring panel 12, of the retention element 45, and of the second actuation tab 40 in relation to the can L.

In the illustrated construction, the extracting end portion 31 of the first actuation tab 30 is positioned through the grip end portion 42, of annular shape, of the second actuation tab 40, with the grip end portion 32 of the first actuation tab 30 being positioned over the punching end portion 41 of the second actuation tab 40, and with the extracting end portion 31 of the first actuation tab 30 being positioned under the grip end portion 42 of the second actuation tab 40.

With the construction described above, if the user/consumer wishes to consume the beverage directly from the can, without using the straw, he/she detaches, initially, the vent panel 11 together with the first actuation tab 30. Subsequently, the user/consumer may provide the manual and angular displacement of the grip end portion 42 of the second actuation tab 40, so as to detach it from the end wall 10 of the can L, together with the pouring panel 12.

Figure 2:
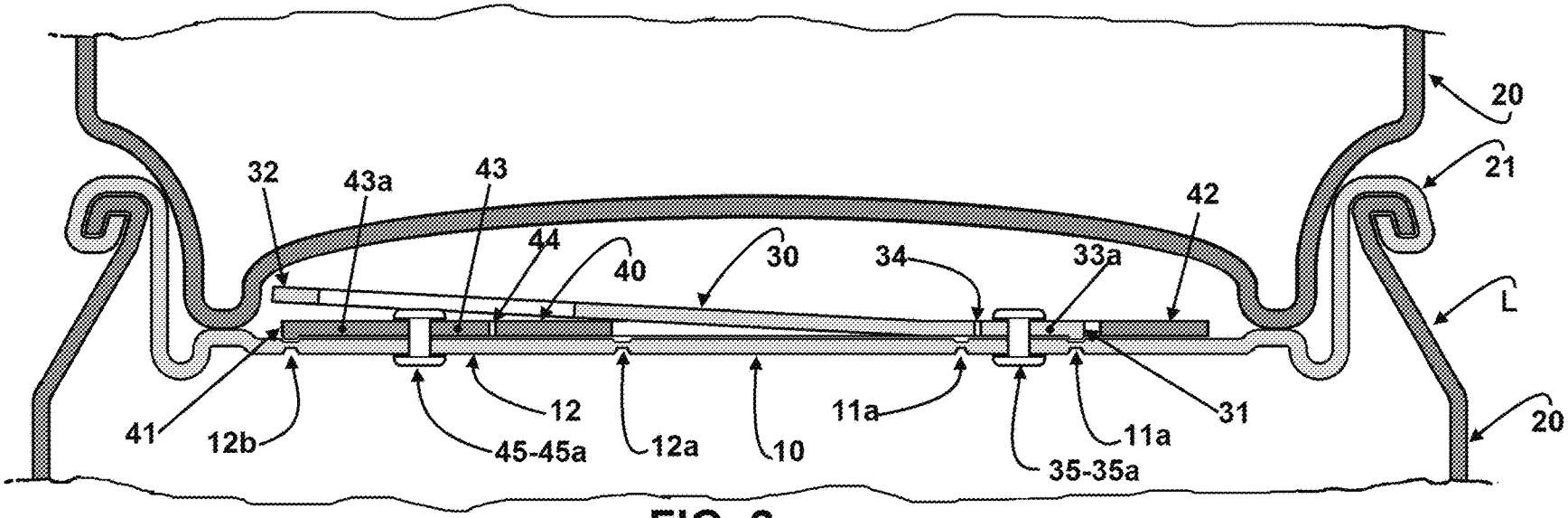
FIG. 2 represents an enlarged diametric sectional view of the upper portion of the can of FIG. 1, further illustrating the bottom of other can stacked thereon.
Figure 2A:
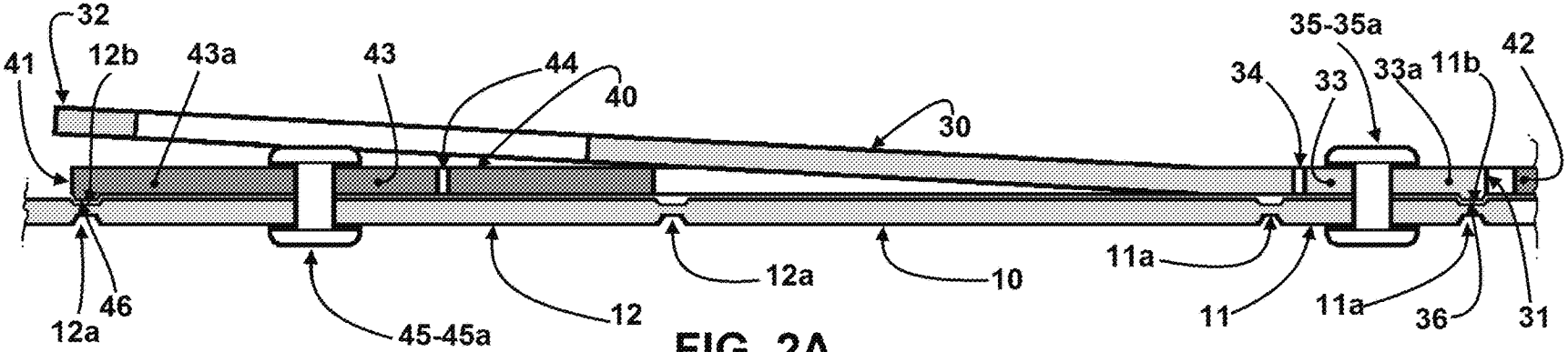
FIG. 2A represents, in an enlarged detail, the central region of the upper portion of the can illustrated in FIG. 2.
Figure 3:
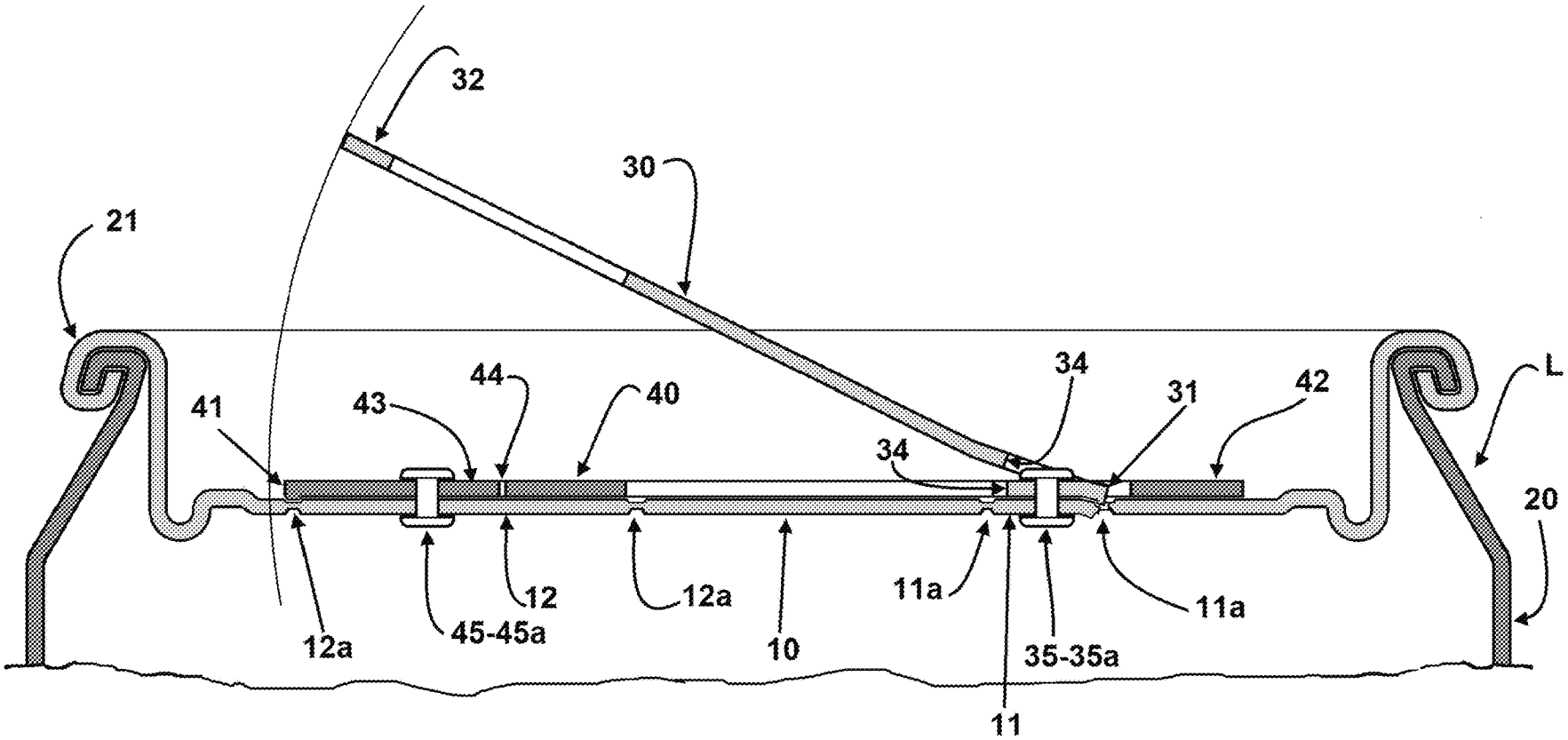
FIG. 3 represents an enlarged diametric sectional view of the upper portion of the can of FIG. 1, in which the second actuation tab has not been activated yet, and in which the pouring panel has not been detached yet from the end wall, but with the first actuation tab being displaced by the user/consumer, in order to start separating the vent panel from the end wall, for forming the vent opening.

As illustrated in FIGS. 1 and 2, in the condition in which the vent panel 11 and the pouring panel 12 are still closed, the first and the second actuation tab 30, 40 remain positioned between the end wall 10 of the can L and the plane of the adjacent edge 21 of the latter, not interfering with the bottom of an identical can L stacked thereon, as illustrated in FIG. 2.

Thus, the constructive solution proposed herein allows the user/consumer to choose whether to form only the vent opening A1, by moving the first actuation tab 30, or also form, subsequently, the pouring opening A2, by displacing the second actuation tab 40. However, it should be noted that any one of said two panels, upon producing a respective opening, is completely detached from the end wall 10 of the can L, without projecting to the interior of the latter.

In relation to the description above, it should be understood that example dimensional relationships for the components of the present disclosure include variations of size, materials, geometric forms, functions, operation modes, mounting arrangements and usage will become apparent. All relationships equivalent to those illustrated in the drawings and described in the specification should be understood as encompassed by the present disclosure.

Thus, while only one way of carrying out the present disclosure has been illustrated herein, it should be understood that modifications as to the shape and formation of the parts can be made, without departing from the protective scope defined in the claims that accompany the present specification.

The invention claimed is:

1. A constructive arrangement for the opening of a beverage can of the type which comprises an end wall, the end wall including a vent panel and a pouring panel, the vent panel spaced apart from the pouring panel, the vent panel has a vent contour defined by a vent rupture line and the pouring panel has a pouring contour defined by a pouring rupture line, a first actuation tab having an extracting end portion, externally affixed to the vent panel at a first rivet encircled by the vent rupture line, and a first grip end portion, which is manually and angularly displaceable away from the end wall of the can, and being separated from the end wall with the vent panel, and a second actuation tab, which is configured to be actuated after the vent panel is removed from the end wall, the second actuation tab having a punching end portion and a second grip end portion, the punching end portion including, in a single piece, a hinge region and a tab portion, the tab portion cut out from the second actuation tab by a cutout and externally affixed to the pouring panel, the second actuation tab being provided with an end lower tooth configured to be pressed against a confronting spot region of the pouring rupture line which defines the pouring contour of the pouring panel, wherein manual angular displacement of the second grip end portion away from the end wall of the can, breaks, initially, the spot region of the pouring rupture line and, subsequently, separates the pouring panel from the end wall, wherein the first actuation tab is operable independently of the second actuation tab.

2. The constructive arrangement according to claim 1, wherein the cutout of the second actuation tab has a shape corresponding to a rounded "C", the cutout open to the hinge region of the second actuation tab.

3. The constructive arrangement, according to claim 1, wherein the extracting end portion of the first actuation tab includes, in a single piece, a hinge region and a tab portion, the tab portion cut out from the first actuation tab by a cutout, the tab portion externally affixed to the vent panel.

4. The constructive arrangement, according to claim 3, wherein the cutout of the first actuation tab has a shape corresponding to a rounded "C", the cutout open to the hinge region of the first actuation tab.

5. The constructive arrangement, according to claim 3, wherein the extracting end portion of the first actuation tab includes an end lower tooth to be pressed against a confronting spot region of the vent rupture line, upon the ascending angular displacement of the grip portion of the first actuation tab around the hinge region of the first actuation tab, provoking the initial rupture of the vent panel and, subsequently, the complete rupture of the vent rupture line and the complete separation of the vent panel and the first actuation tab from the can.

6. The constructive arrangement, according to claim 1, wherein the the punching end portion of the second actuation tab is affixed to the pouring panel by a second rivet.

7. The constructive arrangement, according to claim 1, wherein the second grip end portion of the second actuation tab has an annular shape, with an axial projection of the vent rupture line of the vent panel being contained in an interior of the annular shape of the grip portion of the second actuation tab.

8. The constructive arrangement, according to claim 7, wherein the extracting end portion of the first actuation tab is positioned through the second grip end portion of the second actuation tab, with the first grip end portion of the first actuation tab being positioned over the punching end portion of the second actuation tab, and with the extracting end portion of the first actuation tab being positioned under the second grip end portion of the second actuation tab.

9. An apparatus for opening a can that includes an end wall having a vent panel, and a pouring panel spaced apart from the vent panel, the apparatus comprising:

a first contour of the vent panel, wherein the first contour is defined by a first rupture line;

a second contour of the pouring panel, wherein the second contour is defined by a second rupture line;

a first actuation tab having:

an extracting end portion externally affixed to the vent panel at a first rivet encircled by the first rupture line; and a first grip end portion, wherein the first grip end portion is displaceable relative to the end wall, and wherein the first grip end portion is configured to be separated from the end wall in conjunction with the vent panel; and a second actuation tab, wherein:

the second actuation tab is actuated in response to removing the vent panel;

the second actuation tab is externally affixed to the pouring panel;

the second actuation tab includes a second punching end portion and a second tab portion, wherein the second tab portion is separated from the second punching end portion via a second hinge;

the second tab portion includes a second end lower tooth that abuts a second spot region of the second rupture line;

the second actuation tab includes a second grip end portion;

the second grip end portion is displaceable relative to the end wall;

the second end lower tooth is configured to break the second spot region of the second rupture line;

in response to breaking the second spot region of the second rupture line, the pouring panel is configured to separate from the end wall; and the first actuation tab is operable independently of the second actuation tab.

10. The apparatus of claim 9, wherein the second hinge forms a shape corresponding to a rounded "C" and is disposed around a second hinge region of the second actuation tab.

11. The apparatus according to claim 9, wherein the first actuation tab includes a first tab portion that is separated from the extracting end portion via a first recess.

12. The apparatus of claim 11, wherein the first hinge forms a shape corresponding to a rounded "C" and is disposed around a first hinge region of the first actuation tab.

13. The apparatus according to claim 11, wherein:

the extracting end portion includes a first end lower tooth that abuts a first spot region of the first rupture line in response to an ascending angular displacement of the first grip end portion around a first hinge region of the first actuation tab;

in response to the ascending angular displacement, the extracting end portion is configured to rupture the vent panel and the first rupture line; and in response to rupturing the first rupture line, the extracting end portion is configured to separate the vent panel and the first actuation tab from the can.

14. The apparatus according to claim 9, wherein:

the extracting end portion is affixed to the vent panel using a first rivet; and the second punching end portion is affixed to the pouring panel using a second rivet.

15. The apparatus according to claim 9, wherein:

the second grip end portion has an annular shape; and an axial projection of the first rupture line is contained in an interior portion of the second grip end portion.

16. The apparatus according to claim 15, wherein:

the first grip end portion is positioned over the second punching portion; and the extracting end portion is positioned under the second grip end portion.

17. The constructive arrangement according to claim 1, wherein the pouring panel is larger than the vent panel.

18. The apparatus according to claim 11, wherein the pouring panel is larger than the vent panel.

19. A constructive arrangement for the opening of a beverage can of the type which comprises an end wall, the end wall including a vent panel and a pouring panel, the vent panel spaced apart from the pouring panel, the vent panel has a vent contour defined by a vent rupture line and the pouring panel has a pouring contour defined by a pouring rupture line, a first actuation tab having an extracting end portion, externally affixed to the vent panel, and a first grip end portion, which is manually and angularly displaceable away from the end wall of the can, and being separated from the end wall with the vent panel, and a second actuation tab, which is configured to be actuated after the vent panel is removed from the end wall, the second actuation tab having a punching end portion and a second grip end portion, the punching end portion including, in a single piece, a hinge region and a tab portion, the tab portion cut out from the second actuation tab by a cutout and externally affixed to the pouring panel at a second rivet encircled by the pouring rupture line, the second actuation tab being provided with an end lower tooth configured to be pressed against a confronting spot region of the pouring rupture line which defines the pouring contour of the pouring panel, wherein manual angular displacement of the second grip end portion away from the end wall of the can, breaks, initially, the spot region of the pouring rupture line and, subsequently, separates the pouring panel from the end wall, wherein the first actuation tab is operable independently of the second actuation tab.

20. The constructive arrangement according to claim 19, wherein the extracting end portion is externally affixed to the vent panel at a first rivet encircled by the vent rupture line.

* * * * *